US006685370B2

(12) United States Patent
Hiramatsu

(10) Patent No.: US 6,685,370 B2
(45) Date of Patent: Feb. 3, 2004

(54) RECORDING MEMBER FEEDING DEVICE WITH DETECTING MEANS FOR IMPROVED PRECISION AND IMAGE FORMING APPARATUS CONTAINING SAME

(75) Inventor: Soichi Hiramatsu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 09/866,602

(22) Filed: May 30, 2001

(65) Prior Publication Data

US 2001/0053303 A1 Dec. 20, 2001

(30) Foreign Application Priority Data

Jun. 16, 2000 (JP) ..... 2000-183583
Jun. 19, 2000 (JP) ..... 2000-183584

(51) Int. Cl.[7] ..... B41J 11/64; B41J 13/03

(52) U.S. Cl. ..... 400/640; 400/629; 271/10.05; 347/104

(58) Field of Search ..... 400/562, 624, 400/625, 626, 627, 628, 629, 636, 637, 638, 639, 640, 641, 709; 271/10.01, 10.05, 10.09, 10.11; 347/16, 104

(56) References Cited

U.S. PATENT DOCUMENTS 3,901,371 A * 8/1975 Scott, Jr. ..... 101/93.19
5,209,589 A * 5/1993 Bliss ..... 226/30
5,580,042 A 12/1996 Taniguro et al. ..... 271/272
5,598,201 A * 1/1997 Stodder et al. ..... 271/272
5,620,174 A 4/1997 Taniguro et al. ..... 271/10.12
5,672,019 A 9/1997 Hiramatsu et al. ..... 400/624
5,674,019 A * 10/1997 Munakata et al. ..... 400/568
5,793,399 A 8/1998 Kawakami et al. ..... 347/104
6,092,940 A * 7/2000 Wiklof et al. ..... 400/88
6,126,346 A * 10/2000 Hibino et al. ..... 400/636
6,377,291 B2 * 4/2002 Andoh et al. ..... 347/176

FOREIGN PATENT DOCUMENTS

JP 7-186484 7/1995
JP 8-90862 4/1996

* cited by examiner

*Primary Examiner*—Daniel J. Colilla
*Assistant Examiner*—Jill E. Culler
(74) *Attorney, Agent, or Firm*—Fitzpatrick, Cella, Harper & Scinto

(57) ABSTRACT

A recording member feeding device feeds a recording member such as a sheet in an image recording apparatus such as a copying machine. The recording member feeding device has a feeding rotary unit, a driving unit for driving the feeding rotary unit, and a driving power transmitting unit for transmitting he power of the driving unit to the feeding rotary unit. The recording member feeding device further has a rotation detecting unit for detecting the number of rotations of a rotary part in the rotary driving unit or in the driving power transmitting unit. The feeding rotary unit feeds the recording member by a length which is determined by the number of complete rotations detected by the rotation detecting units.

22 Claims, 7 Drawing Sheets

RECORDING MEMBER FEEDING DEVICE WITH DETECTING MEANS FOR IMPROVED PRECISION AND IMAGE FORMING APPARATUS CONTAINING SAME

BACKGROUND OF THE INVENTION

1. Field of the Invention

The present invention relates to an image forming apparatus which records an image on a recording member such as a recording sheet and, more particularly, to a recording member feeding device for use on the image forming apparatus.

2. Description of the Related Art

One type of the recording apparatuses of the kind described above is an apparatus known as a "serial printer" in which a carriage carrying a recording head is moved in the widthwise direction of the recording member, thereby enabling the recording head to record information on the surface of the recording member.

In the operation of the serial recording apparatus, feed of the recording member and the recording performed by the recording head on the carriage are repeatedly performed in an alternating fashion, thereby performing recording on a certain area of the recording member.

In recent years, there has been an increasing demand for faster and quieter recording operations and, to cope with that demand, various improvements have been proposed with regard to the feeding of the recording member. One such improvement employs a detector which measures the amount of feeding operation of a feeder and which produces a signal for controlling a driving device such as a motor, thereby performing faster and quieter recording operation.

Demands also exist for higher quality recorded images, requiring a higher definition or fineness of recording which is achieved by the use of recording heads having smaller pixel pitches, and also requiring higher precision of feeding of the recording member.

Thus, greater precision of feed control is required, in addition to faster and quieter recording.

The above-described solution, however, encounters the following problems.

In the above-described configuration, which employs a detector for measuring the amount of feeding operation of a feeder and for producing a signal for controlling a driving device such as a motor, the feeding precision for recording member feed is primarily determined by the precision of detection performed by the detector.

Therefore, approaches have been made towards achieving higher resolution of the detecting element used in the detector, as well as greater fineness of an object, e.g., slits, to be detected.

Greater fineness of the detection object requires a finer pitch of the detection objects such as slits, as well as higher precision of machining of the detection objects.

This inevitably leads to a rise in the production cost. When a disk encoder scale for measuring the amount of rotation is used as the detection object, a higher resolution can be obtained by increasing the size of the disk, even if the pitch of the slit remains unchanged. Unlimited increase in the disk size, however, is not possible due to size requirements for the image forming apparatus.

On the other hand, detectors having higher resolution, i.e., higher detecting performance, are generally expensive and raise the production costs.

Another approach to achieving higher precision of feed of the recording member is to improve the mechanical precision of the parts of the recording member feeding device and driving unit, in particular to minimize eccentricities of rotary parts which are incorporated in transmission systems which transmit rotation.

Approaches have been made toward minimizing the influence of eccentricity, particularly when the object to be detected is, for example, a disk encoder scale used for measurement of rotation amount.

Hitherto, the amount of feed of a recording member has been directly measured or measured indirectly through detection of amount of rotation of another member, for example, a feed roller.

For instance, direct detection systems have been proposed in which a detection object such as a roller is held in contact with a feeding member or with the recording member, and the amount of feed is determined in terms of the product of the amount of rotation of the roller and the circumferential length of the roller, thereby enhancing the feeding precision, as disclosed in, for example, Japanese Patent Laid-Open Nos. 7-186484 and 8-90862.

This configuration, however, requires a roller and associated parts, resulting in higher production costs and greater size of the apparatus.

The detection system relying upon detection of amount of rotation of a feed roller also has a problem in that an exact 1:1 correspondence between the amount of rotation of the feed roller and the amount of rotation of an encoder scale as the detection object cannot be achieved, unless the feeding of the recording member is performed at a considerably large pitch.

SUMMARY OF THE INVENTION

Accordingly, it is an object of the present invention to provide a recording member feeding device, as well as an image forming apparatus, which is improved to achieve a higher precision of feed of the recording member while performing faster and quieter recording operations without causing a rise in the production cost, thereby overcoming the above-described problems of the known art.

To this end, according to the present invention, there is provided a recording member feeding device, comprising: a feeding rotary unit for feeding a recording member; a rotary driving unit for driving the feeding rotary means; a driving power transmitting unit for transmitting the driving power from the rotary driving unit to the feeding rotary means; and detecting unit provided in the rotary driving unit or in the driving power transmitting unit, for measuring the amount of rotation caused by the rotary driving unit.

Preferably, the arrangement is such that the number of complete rotations detected by the detecting unit is an integral multiple of the number of feeding operations performed by the feeding rotary unit.

In one form of the present invention, the detecting unit includes a detection object coaxially fixed to a rotary member of one of the rotary driving unit and the driving power transmitting unit, and a rotation sensor for measuring the amount of rotation of the detection object; wherein the number of complete rotations of the rotary member to which the detection object is fixed is an integral multiple of the feeding operations performed by the feeding rotary unit.

The arrangement also may be such that the rotary driving unit and the feeding rotary unit have rotary members drivingly connected to the power transmitting unit, and wherein the power transmitting unit is a speed-reducing transmitting unit in which the amount of rotation of the rotary member of the rotary driving unit is greater than that of the rotary member of the feeding rotary unit.

The present invention in another aspect provides an image forming apparatus in which the above-described recording member feeding device is associated with an image recording device which records an image on the recording member fed by the recording member feeding device.

In accordance with the present invention, it is possible to achieve a higher feeding precision of the recording member to improve image quality, as well as faster and quieter recording operation, without being accompanied by a rise in the costs or an increase in the size of the apparatus, by virtue of the provision of the detecting unit in the driving means or the driving power transmitting means and which detects the amount of the drive.

The amount of rotation of the rotary member in the driving unit or in the driving power transmitting unit is greater than that of the rotary member in the feeding unit, thus enhancing the resolution of the detecting unit with regard to the amount of feed of the recording member, thus contributing to improvement in the feeding precision.

Further, any undesirable effects produced by offset or eccentricity of the detection object to be detected by the detecting unit is canceled and, at the same time, the resolution of the detecting unit is enhanced, if the arrangement is such that the number of rotations detected by the detecting unit is an integral multiple of the number of the feeding operation performed by the feeding unit.

Further objects, features and advantages of the present invention will become apparent from the following description of the preferred embodiments with reference to the attached drawings.

DESCRIPTION OF THE PREFERRED EMBODIMENTS

Preferred embodiments of the present invention will now be described with reference to the drawings, by way of example only. Thus, dimensions, materials, shapes and relative positions of parts or components used in the described embodiments are not intended to limit the scope of the invention, and are subject to changes and modifications in accordance with conditions such as the structure or design of the apparatus or system incorporating the present invention.

First Embodiment

Figure 1:
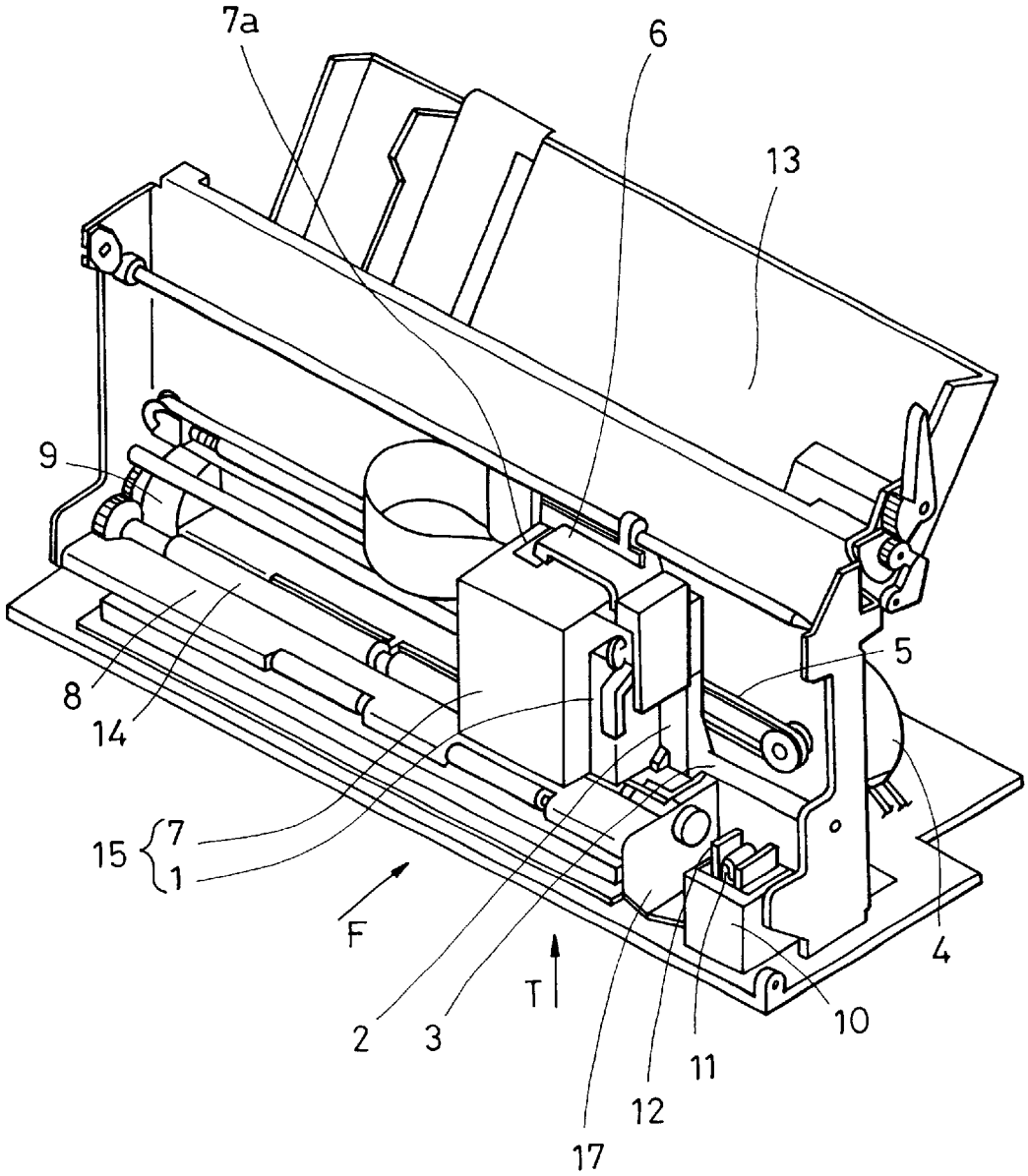
FIG. 1 is a schematic perspective view of an image recording apparatus in accordance with the present invention incorporating an ink-jet recording head.

Referring first to FIG. 1, an ink cartridge 15 is composed of an ink-jet recording head 1 which serves as image recording means and an ink tank 7 which contains ink to be supplied to the recording head 1 and which is integrated with the recording head 1.

Although various types of ink-jet recording heads can be used, the recording head 1 used in this embodiment is of the type in which an ink droplet is discharged in response to a change in the state of the ink caused by thermal energy generated by an electro-thermal transducer, thereby achieving recording of information at high recording density and with a high degree of definition.

The recording head 1 is carried by a carriage 2, at such an angle that it discharges the ink downward as viewed in FIG. 1. The carrier 2 and, hence, the recording head 1 travel along a guide shaft 3 while the recording head 1 discharges ink droplets, thereby forming an image on a recording member (not shown).

The reciprocal motion of the carriage 2 along the guide shaft 3 is effected by a carriage motor 4 having a rotor which is operatively connected to the carriage 2 by means of a timing belt 5. A catch 6 provided on the carriage 2 engages with a hole 7*a* formed in a wall of the ink tank 7, thereby firmly fixing the carriage 2 and the ink tank 7 to each other.

After a main scan performed by the recording head 1, the recording operation is temporarily suspended and, during the suspension, a recording member laid on a platen 8 is fed by a predetermined amount by a feed roller which serves as feeding means and which is driven by a feed motor, serving as driving means. After the feed of the recording member, the carriage 2 is again moved along the guide shaft 3, thereby performing the next recording scan for image formation.

A recovery unit 10 which performs a recovery operation for maintaining good conditions for ink discharge from the recording head 1 is disposed on the right end of the apparatus as viewed in FIG. 1. The recovery unit 10 has a cap 11 for capping the recording head 1, wipers 12 for wiping contaminants off the ink discharge face of the recording head 1, and a suction pump (not shown) for sucking stagnant ink from the ink discharge nozzles of the recording head 1.

The power of the feed motor 9 for feeding the recording member is transmitted not only to the feed roller 14 but also to an automatic sheet feeder (ASF) 13.

Figure 2:
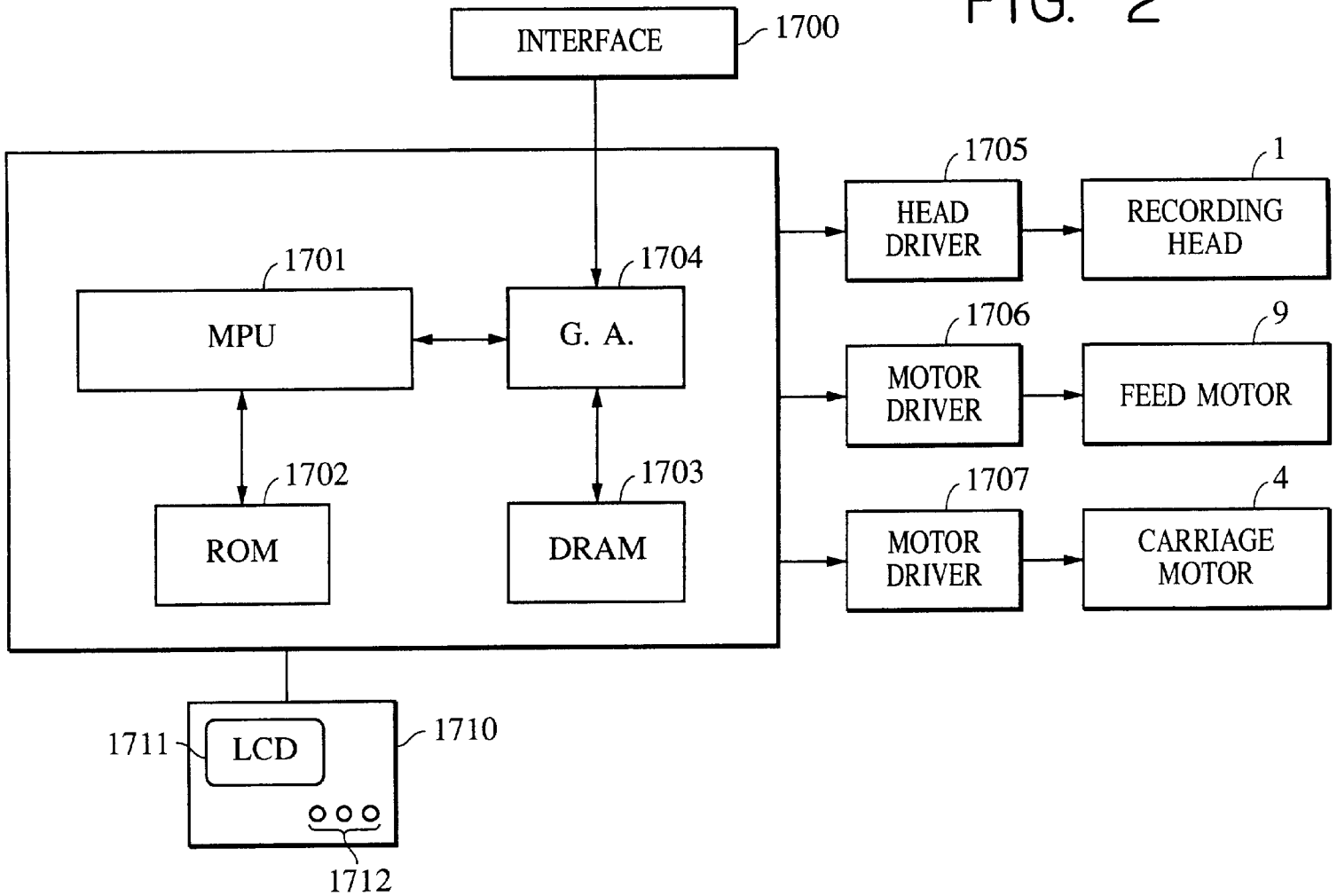
FIG. 2 is a block diagram of a control circuit of the image recording apparatus.

FIG. 2 is a block diagram showing the configuration of a control circuit of the recording apparatus. The control circuit has an interface 1700 through which recording signals are received, a micro processing unit (MPU) 1701, a read-only memory (ROM) 1702 which stores control programs to be executed by the MPU 1701, and a dynamic random access memory (DRAM) 1703 for storing various kinds of data.

The control circuit also has a gate array (G.A.) 1704 which controls the supply of the recording data, as well as the exchange of data among the interface 1700, MPU 1701 and the RAM 1703.

The control circuit further has a head driver 1705 for driving the recording head 1, as well as motor drivers 1706 and 1707 for driving the feed motor 9 and the carriage motor 4, respectively.

In operation, recording signals received through the interface 1700 are transformed into print signals by the cooperation between the gate array 1704 and the MPU 1701. In the meantime, the motor drivers 1706 and 1707 are activated, and the recording head 1 is driven in accordance with the print data received by the head driver 1705, thereby performing the recording.

In FIG. 2, numeral 1710 designates a display section having an LCD 1711, as well as LED lamps 1712 of different colors, for displaying various messages concerning the recording operation and the state of the recording apparatus.

Figure 3:
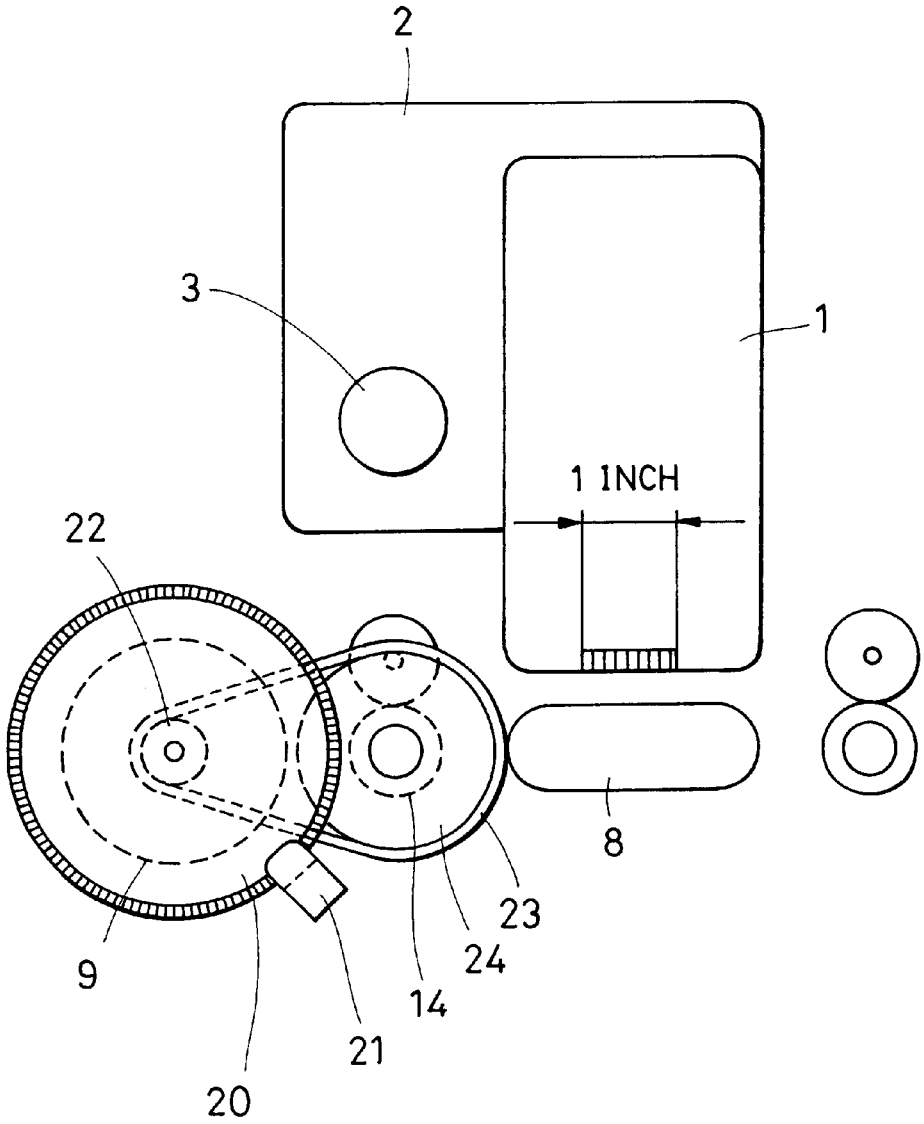
FIG. 3 is a sectional view of a portion of a first embodiment of the recording member feeding device of the present invention, showing a feed roller, as well as components therearound.

FIG. 3 is an enlarged sectional view schematically showing an arrangement around the feed roller 14 and the feed motor 9 of FIG. 1 respectively serving as the feeding rotary means and the rotary driving means.

It is assumed here that the recording head 1 has a nozzle portion which spans 1 inch, i.e., 25.4 mm, as measured in the direction perpendicular to the direction of movement of the carriage. After completion of one cycle of main scanning for recording, the recording operation is suspended and, during the suspension, the recording member on the platen 8 is fed 1 inch in the direction perpendicular to the direction of the main scan, by means of the feed roller 14 driven by the feed motor 9.

The power produced by the feed motor 9 is transmitted from a feed motor pulley 22 to a feed roller pulley 24 through a feed belt 23. Thus, the feed motor pulley 22 serves as a rotary member provided on a power transmitting portion of the feed motor 9, while the feed roller pulley 24 serves as a rotary member of a power transmitting portion of the feed roller 14, with the feed belt 23 serving as the driving power transmitting means. The feed roller pulley 24 and the feed roller 14 are fixed to each other to prevent relative rotation, so that the feed roller 14 makes one complete rotation for each complete rotation of the feed roller pulley 24.

The arrangement is such that three rotations of the feed motor pulley 22 cause one rotation of the feed roller pulley 24. A disk encoder scale member 20, which is coaxially fixed to the feed motor pulley 22, serves as a detection object which is to be detected for the purpose of measurement of the amount of feed of the recording member. The amount of rotation of the encoder scale member 20 is detected by an encoder sensor 21 which serves as detecting means.

The arrangement is such that, for example, the recording member is fed approximately 3 inches per rotation of the feed roller 14. Thus, the feed roller rotates about one third of a complete rotation and, therefore, the feed motor pulley 22 makes approximately one rotation, upon completion of the aforementioned one cycle of recording scanning operation.

In other words, the feed motor pulley 22 and, hence, the encoder scale member 20 make almost one complete rotation in order to effect a unit feed, i.e., 1-inch feed, of the recording member.

In contrast, if the encoder scale member 20 is mounted on the feed roller 14, the feed roller 14 and, hence, the encoder scale member 20 will rotate approximately only one third of a complete rotation, in order to cause the 1-inch feed of the recording member.

It will thus be seen that, for a given diameter and slit pitch of the encoder scale member 20 and given resolution of the encoder sensor 21, a definition which is three times higher is obtained when the encoder scale member 20 is mounted on the feed motor pulley 20 as shown in FIG. 3 than when the same is mounted on the feed roller 14.

In the arrangement shown in FIG. 3, the feeding operation is ceased upon detection of completion of approximately one complete rotation of the encoder scale member 20. This means that undesirable effects caused by any offset or eccentricity of the center of the encoder scale member 20 with respect to the center of rotation of the feed motor pulley 22 are advantageously canceled.

Second Embodiment

A second embodiment will now be described with specific reference to FIG. 4 which is an enlarged sectional view of an arrangement around the feed roller 14 and the feed motor 9 of FIG. 1 respectively serving as the feeding means and the driving means. In this Figure, components or parts which are the same as those employed in the first embodiment are denoted by the same reference numerals as those employed in the foregoing description taken in conjunction with FIG. 3, and detailed descriptions of such parts or components are omitted.

As is the case in the first embodiment shown in FIG. 3, the recording head 1 has a nozzle portion which spans about 1 inch in the recording member feed direction. Thus, upon completion of one cycle of the recording scan, the recording operation is suspended and, during the suspension, the recording member on the platen 8 is fed 1 inch by the feed roller 14 which is driven by the feed motor 9.

The power of the feed motor 9 is transmitted from a feed motor gear 25 to a feed roller gear 27 which serves as a rotary member provided on the power transmitting portion of the feed roller 14, through a transmission gear 26 which serves as driving power transmitting means and also as a rotary member. The feed roller gear 27 and the feed roller 14 are fixed to each other to prevent relative rotation. Thus, the feed roller 14 makes one complete rotation per rotation of the feed roller gear 27.

The transmission gear 26 is a two-staged gear. The arrangement is such that the transmission gear 26 makes one complete rotation per every two complete rotations of the feed motor gear 25, and the feed roller gear 27 makes one complete rotation per every two complete rotations of the transmission gear 26.

A disk-like encoder scale member 20 serving as the detection object for measurement of the feed amount is coaxially fixed to the transmission gear 26, and the amount of rotation of the encoder scale member 20 is detected by an encoder sensor 21 which serves as the detecting means.

The amount of feed of the recording member per rotation of the feed roller 14 is set to be about 2 inches, so that the feed roller 14 rotates about one-half rotation upon completion of one cycle of the recording scan. This amounts to approximately one complete rotation of the transmission gear 26.

A comparison which is similar to that described before in connection with the first embodiment will now be given.

If the encoder scale member 20 is mounted on the feed roller 14, the encoder scale member 20 rotates by an amount which is the same as the amount of rotation of the feed roller 14, i.e., one-half of one complete rotation, after completion of one cycle of recording scan performed by the recording head.

Figure 4:
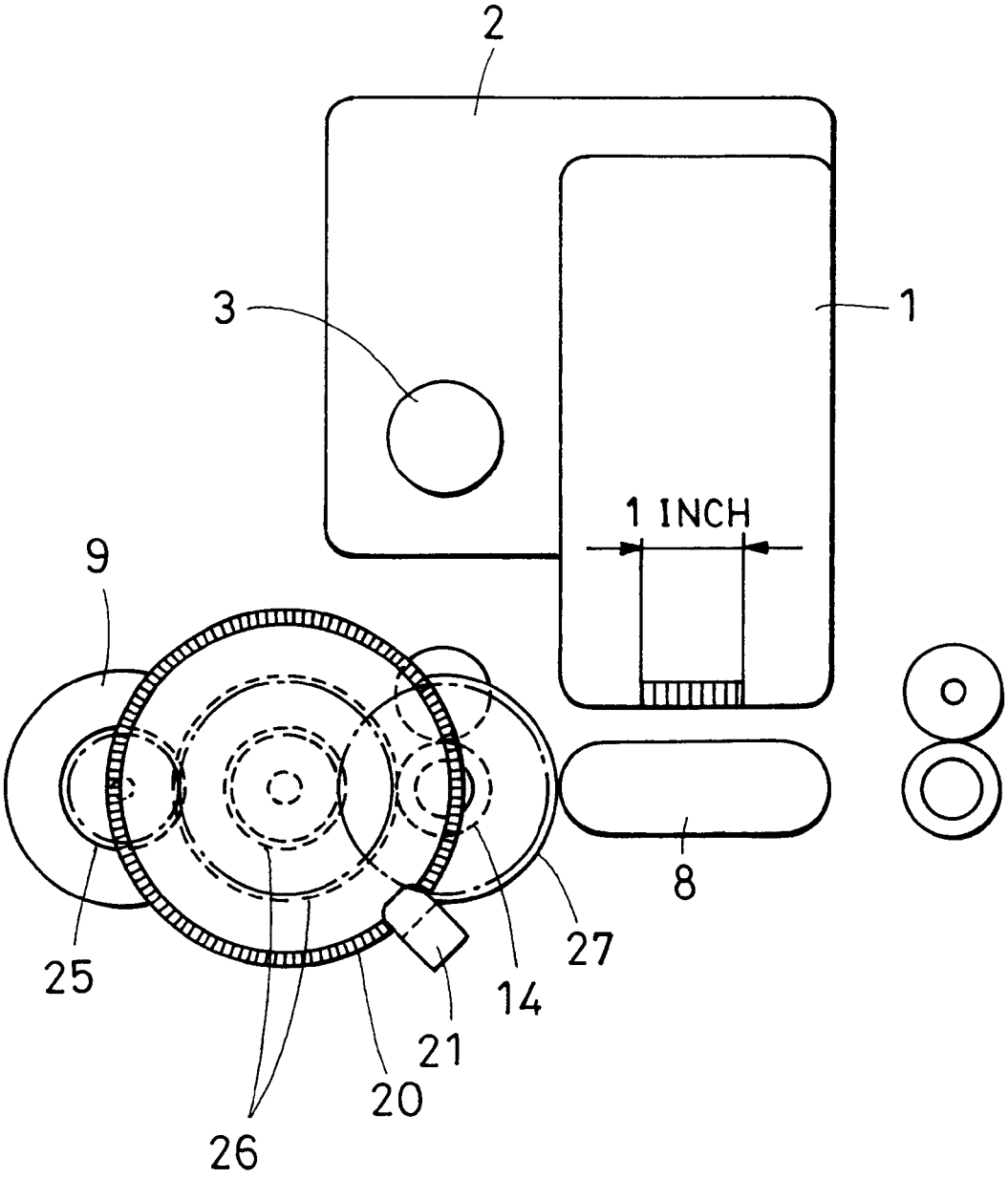
FIG. 4 is a sectional view of a portion of a second embodiment of the recording member feeding device of the present invention, showing a feed roller, as well as components therearound.

For a given diameter and slit pitch of the encoder scale member 20 and a given resolution of the encoder sensor 21, the arrangement shown in FIG. 4 in which the encoder scale member 20 carried by the transmission gear 26 provides a definition which is two times higher than that obtained when the encoder scale member 20 is carried by the feed roller 14.

In the operation of the embodiment shown in FIG. 4, the feed of the recording member is stopped upon detection of about one complete rotation of the encoder scale member 20. Therefore, undesirable effects on feeding precision caused by any offset or eccentricity of the center of the encoder scale member with respect to the center of rotation of the transmission gear 26 is advantageously canceled.

Thus, the first and second embodiments as described provide higher definition and resolution in the measurement of the feed amount of the recording member and effectively cancel undesirable effects which otherwise may be caused by any eccentricity of the detection object in each feed of the recording member by a unit feed amount. It is thus possible to achieve a higher precision of control of the feed amount while achieving a faster and quieter recording operation.

Although in the foregoing description the number of rotations of the feeding means is greater than that of the driving means, the present invention does not exclude the use of a reducing-type transmission means in which the amount or angle of rotation of the driving means is greater than that of the feeding means.

Third Embodiment

Figure 5:
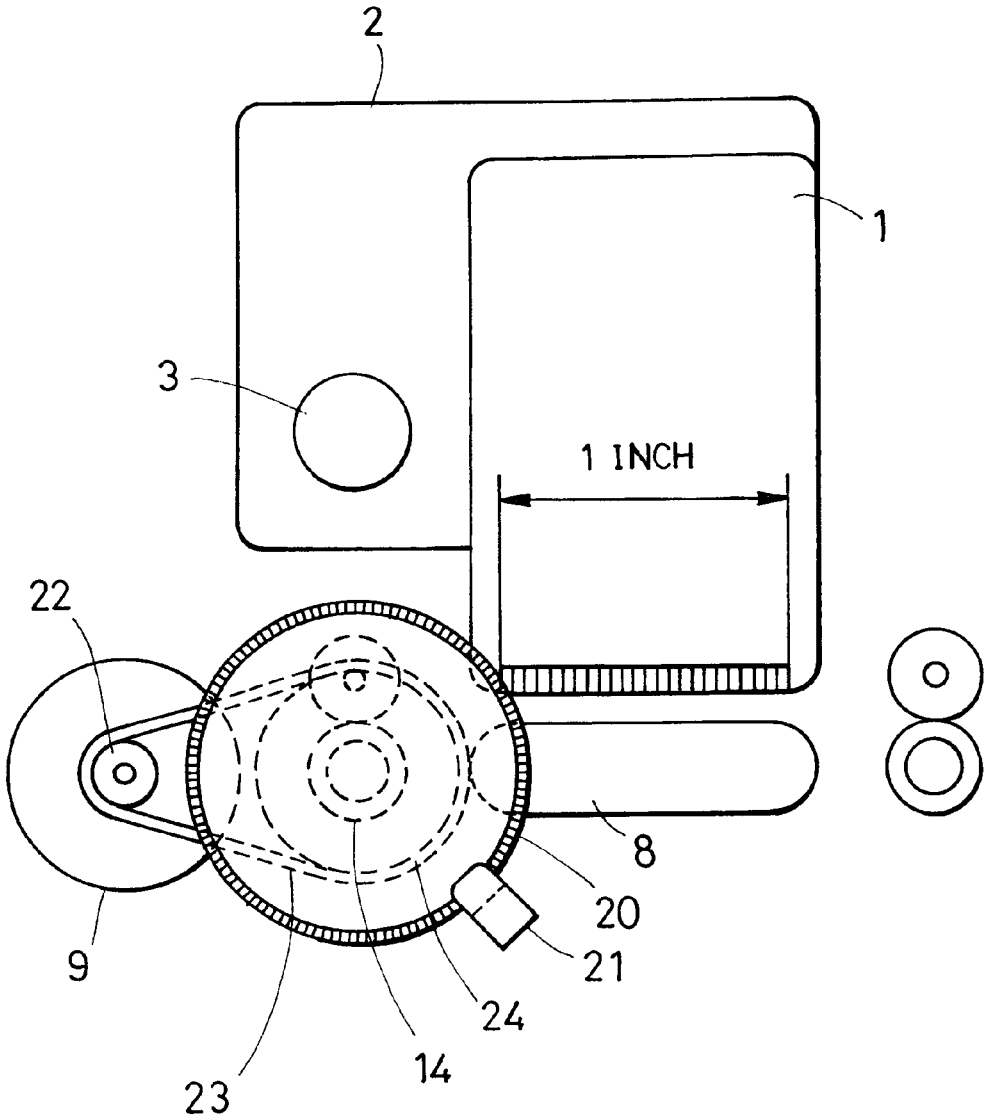
FIG. 5 is a sectional view of a portion of a third embodiment of the recording member feeding device of the present invention, showing a feed roller, as well as components therearound.

FIG. 5 is an enlarged sectional view of an arrangement around the feed roller 14 and the feed motor 9 of FIG. 1 respectively serving as the feeding means and the driving means.

It is assumed here that the recording head 1 has a nozzle portion which spans 1 inch, i.e., 25.4 mm, as measured in the direction perpendicular to the direction of movement of the carriage. Upon completion of one cycle of main scan for recording, the recording operation is suspended and, during the suspension, the recording member on the paten 8 is fed 1 inch in the direction perpendicular to the main scan, by means of the feed roller 14 driven by the feed motor 9.

A disk-type encoder scale member 20 serving as the detection object for the feed amount detection is coaxially fixed to the feed roller 14 serving as the rotary member. The amount of rotation of the encoder scale member 20 is detected by an encoder sensor 21 serving as the detecting means.

The power of the feed motor 9 is transmitted from a feed motor pulley 22 to a feed roller pulley 24 through a feed belt 23 which functions as the driving power transmitting means. The feed roller pulley 24 and the feed roller 14 are fixed to each other to prevent relative rotation, so that the feed roller 14 makes one complete rotation per one complete rotation of the feed roller pulley 24.

The amount of feed of the recording member per one rotation of the feed roller 14 is set to be 1 inch. Thus, the feed roller 14 makes approximately one complete rotation, upon completion of one cycle of recording scan.

As stated before, both the feed roller pulley 24 and the encoder scale member 20 are fixed to the feed roller 14 and, therefore, make one complete rotation per rotation of the feed roller 14.

Thus, the encoder scale member 20 makes approximately one complete rotation per unit feed, i.e., 1-inch feed, of the recording member. If the arrangement is such that the feeding operation is stopped when one complete rotation of the encoder scale member is detected, it is possible to eliminate undesirable effects on feeding precision which may be caused by any offset or eccentricity of the center of the encoder scale member 20 from the center of rotation of the feed roller 14.

Fourth Embodiment

Figure 6:
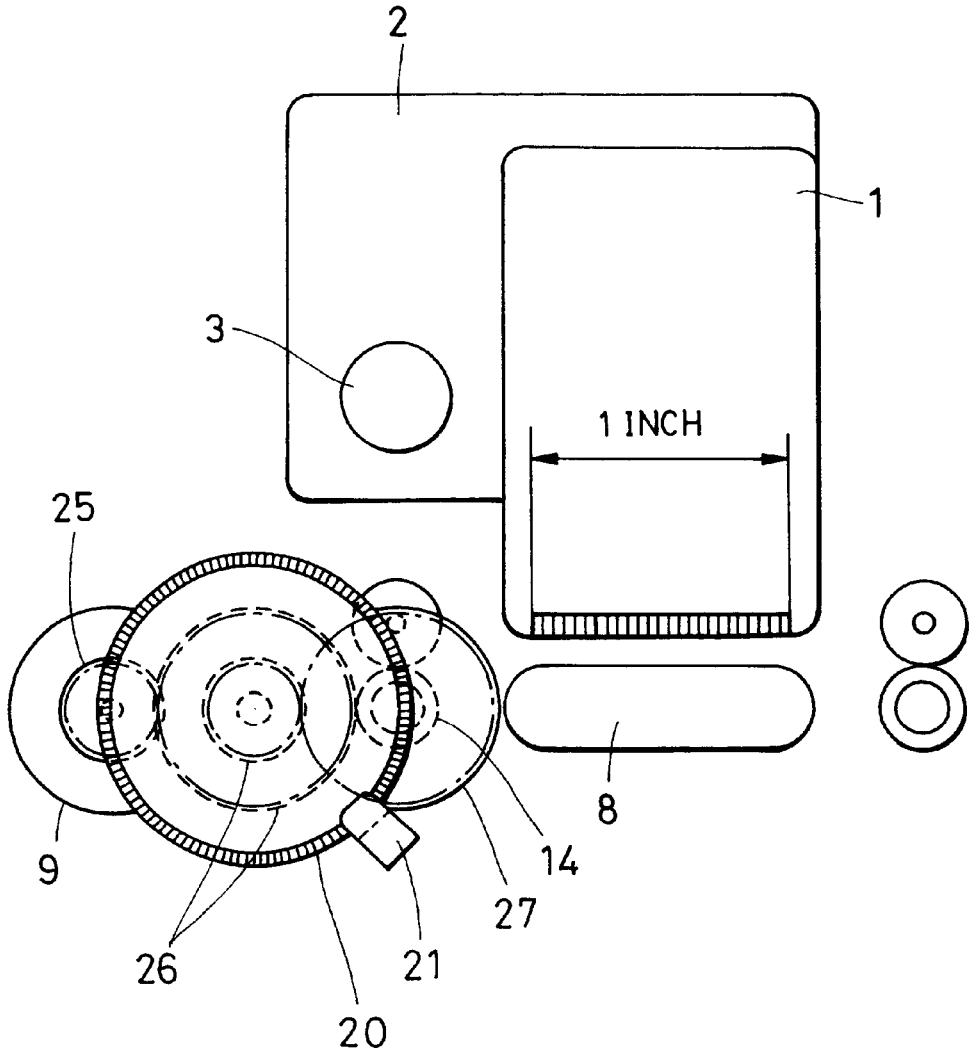
FIG. 6 is a sectional view of a portion of a fourth embodiment of the recording member feeding device of the present invention, showing a feed roller, as well as components therearound.

A fourth embodiment will now be described with specific reference to FIG. 6 which is an enlarged sectional view of an arrangement around the feed roller 14 and the feed motor 9 respectively serving as the feeding means and the driving means. In this Figure, components or parts which are the same as those employed in the first embodiment are denoted by the same reference numerals as those employed in the foregoing description taken in conjunction with FIG. 5, and detailed descriptions of such parts or components are omitted.

As is the case of the third embodiment shown in FIG. 5, the recording head 1 has a nozzle portion which spans about 1 inch in the recording medium feed direction. Thus, after completion of one cycle of the recording scan, the recording operation is suspended and, during the suspension, the recording member on the platen 8 is fed 1 inch by the feed roller 14 which is driven by the feed motor 9.

The power of the feed motor 9 is transmitted from a feed motor gear 25 to a feed roller gear 27, through a transmission gear 26 which serves as driving power transmitting means. The feed roller gear 27 and the feed roller 14 are fixed to each other to prevent relative rotation. Thus, the feed roller 14 makes one complete rotation per one complete rotation of the feed roller gear 27.

The transmission gear 26 is a two-staged gear. The arrangement is such that the transmission gear 26 makes one complete rotation per two complete rotations of the feed motor gear 25, and the feed roller gear 27 makes one complete rotation per two complete rotations of the transmission gear 26.

A disk-like encoder scale member 20 serving as the detection object for measurement of the feed amount is coaxially fixed to the transmission gear 26, and the amount of rotation of the encoder scale member 20 is detected by an encoder sensor 21 which serves as the detecting means.

The amount of feed of the recording member per one complete rotation of the feed roller 14 is set to be about 1 inch, so that the feed roller 14 rotates about one complete rotation upon completion of one cycle of recording scan. This amounts to approximately two complete rotations of the transmission gear 26.

During feed of the recording member by unit amount which is 1 inch in this embodiment, the transmission gear 26 and, hence, the encoder scale member 20, make approximately two rotations. Therefore, if the arrangement is such that the feeding operation is stopped upon detection of two complete rotations of the encoder scale member 20, it is possible to cancel undesirable effects on the feeding precision which are caused by any offset or eccentricity of the center of the encoder scale member 20 from the center of rotation of the transmission gear 26.

Since the encoder scale member 20 is mounted on the transmission gear 26, any undesirable effect on feeding precision, which may be caused by offsets or eccentricities of rotary parts included in the power transmission path between the feed motor 9 and the transmission gear 26, can advantageously be canceled regardless of the type of the power transmission path.

This advantage, however, does not apply to the transmission path between the transmission gear 26 and the feed roller 14. Namely, undesirable effects on feeding precision which may be caused by an offset or eccentricity of rotary parts involved in this transmission path cannot be eliminated by the control which relies on the detection of rotation of the encoder scale member 20.

In order to obviate this problem, in this embodiment, the transmission path between the transmission gear 26 and the feed roller 14 is designed such that the number of rotations of each rotary part involved in this transmission path is an integral multiple of the number of feeding operations. Therefore, undesirable effects on feeding precision caused by offset or eccentricity of rotary parts included in this transmission path also can be eliminated, so that further improvement in the feeding precision can be achieved.

The encoder scale member 20 and the encoder sensor 21 may be the same as those used in the third embodiment shown in FIG. 5. In the third embodiment, the encoder scale member 20 makes one complete rotation per unit feed of the recording member by 1 inch, whereas, in the fourth embodiment, the encoder scale member 20 makes two complete rotations. Thus, the fourth embodiment provides a higher definition for the amount of feed of the recording member.

Fifth Embodiment

Figure 7:
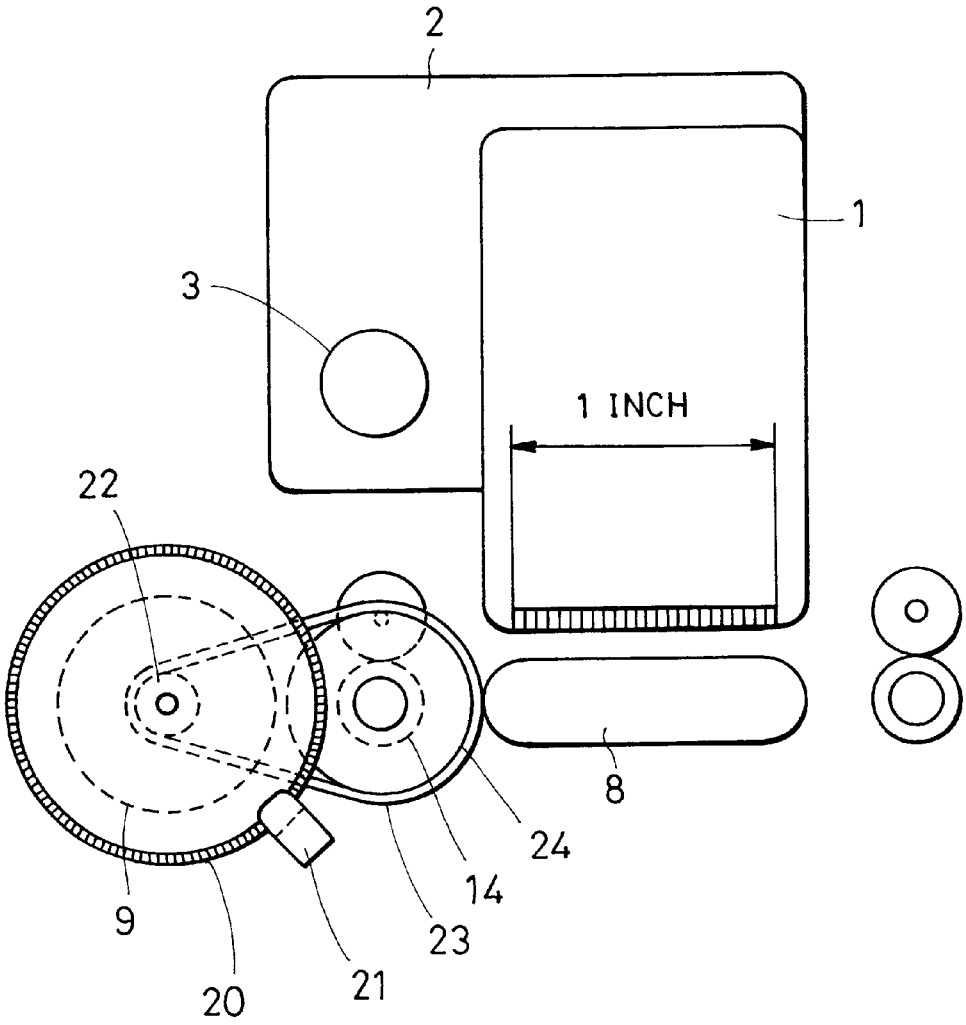
FIG. 7 is a sectional view of a portion of a fifth embodiment of the recording member feeding device of the present invention, showing a feed roller, as well as components therearound.

A fifth embodiment of the present invention will now be described with reference to FIG. 7 which is an enlarged sectional view showing an arrangement around a feed roller 14 serving as the feeding means and a feed motor 9 serving as the driving means.

As in the case of the third embodiment shown in FIG. 5, the recording head 1 has a nozzle portion which spans 1 inch in the recording member feed direction. Upon completion of one cycle of recording scan performed by the recording head 1, the recording operation is suspended and, during the suspension, the recording member on the platen 8 is fed 1 inch by the feed roller 14 which is driven by the feed motor 9.

The power of the feed motor 9 is transmitted from a feed motor pulley 22 to a feed roller pulley 24 through a transmission belt 23. The feed roller pulley 24 and the feed roller 14 are fixed to each other to prevent relative rotation, so that the feed roller 14 makes one complete rotation per rotation of the feed roller pulley 24.

The transmission system is arranged such that the feed roller pulley 24 makes one complete rotation per three rotations of the feed motor pulley 22. A disk-type encoder scale member 20, which serves as a detection object for measurement of the amount of feed of the recording member, is coaxially mounted on the feed motor pulley 22 serving as a rotary member. The amount of rotation of the encoder scale member 20 is detected by an encoder sensor 21 which serves as detecting means.

The amount of feed of the recording member per rotation of the feed roller is set to be about 1 inch. Thus, for every cycle of the recording scan performed by the recording head, the feed roller makes approximately one complete rotation. This amounts to approximately three rotations of the feed motor pulley 22.

In this embodiment, the feed motor pulley 22 and, hence, the encoder scale member 20 make approximately three rotations each time the recording member is fed by a unit amount which in this embodiment is 1 inch. Therefore, if the arrangement is such that the feeding operation is stopped upon detection of three rotations of the encoder scale member, it is possible to cancel undesirable effects on feeding precision attributable to any offset or eccentricity of the encoder scale member 20 from the center of rotation of the feed motor pulley 22.

Since the encoder scale member 20 is mounted on the feed motor pulley 22, undesirable effects on feeding precision, which may be caused by any offset or eccentricity of each of the feed motor rotor and the feed motor pulley 22 can advantageously be canceled.

This advantage, however, is not achieved in the transmission path between the feed motor pulley 22 and the feed roller 14. That is, undesirable effects on feeding precision which may be caused by any offset or eccentricity of rotary parts involved in this transmission path cannot be eliminated by the control which relies on the detection of rotation of the encoder scale member 20 carried by the feed motor pulley 22.

In order to obviate this problem, in this embodiment, the transmission path between the feed motor pulley 22 and the feed roller 14 is designed such that the number of rotations of each rotary part involved in this transmission path is an integral multiple of the number of feeding operations. Therefore, undesirable effects on feeding precision caused by offset or eccentricity of rotary part included in this transmission path also can be eliminated, so that further improvements in the feeding precision can be achieved.

The encoder scale member 20 and the encoder sensor 21 may be the same as those used in the third embodiment shown in FIG. 5. In the third embodiment, the encoder scale member 20 makes one complete rotation per 1 inch unit feed of the recording member, whereas, in the fifth embodiment, the encoder scale member 20 makes three complete rotations. Thus, the fifth embodiment provides a higher definition for the amount of feed of the recording member.

As will be understood from the foregoing description, according to the present invention, undesirable effects on feeding precision which may be caused during unit feed of the recording member by any offset or eccentricity of a detection object can advantageously be canceled, thus contributing to improvement in the precision of feed of the recording material, while achieving faster and quieter recording operation.

While the present invention has been described with reference to what are presently considered to be the preferred embodiments, it is to be understood that the invention is not limited to the disclosed embodiments. Rather, the invention is intended to cover various modifications and equivalent arrangements included within the spirit and scope of the appended claims.

What is claimed is:

1. A recording member feeding device, comprising:

a feed roller for feeding a recording member;

a feed motor for driving said feed roller;

driving power transmitting means for transmitting the driving power from the feed motor to said feed roller;

detecting means for measuring an amount of rotation of said feed roller, said detecting means comprising an encoder scale member mounted on said feed motor and an encoder scale sensor for detecting the amount of rotation of the encoder scale member; and a controller which stops the feeding operation by said feed roller when an integral multiple of one complete rotation of the encoder scale member is detected.

2. A recording member feeding device according to claim 1, wherein the amount of rotation of said feed motor is greater than that of said feed roller.

3. A recording member feeding device according to claim 1, wherein said driving power transmitting means comprises a motor pulley mounted on said motor and the amount of rotation of said motor pulley is greater than that of said feed roller.

4. A recording member feeding device according to claim 1, wherein said driving power transmitting means comprise pulleys and a belt, and said encoder scale member and one of said pulleys are coaxially mounted on said feed roller.

5. A recording member feeding device according to claim 1, wherein said driving power transmitting means comprises pulleys and a belt, and wherein said pulleys and belt provide a reduction ratio of 1:3 such that the feed roller makes one complete rotation for each three complete rotations of said motor.

6. A recording member feeding device according to claim 1, wherein said feed roller has a rotary members drivingly connected to said diving power transmitting means, and wherein said driving power transmitting means is a speed-reducing transmitting means in which the amount of rotation of said rotary members of said feed motor is greater than that of said rotary member of said feed roller.

7. An image recording apparatus, comprising:

a feed roller for feeding a recording member;

a feed motor for driving said feed roller;

driving power transmitting means for transmitting the driving power from the feed motor to said feed roller; and detecting means for measuring an amount of rotation of said feed roller, said detecting means comprising an encoder scale member mounted on said feed motor and an encoder scale sensor for detecting the amount of rotation of the encoder scale member;

image recording means for recording an image on the recording member fed by said feed roller; and a controller which stops the feeding operation by said feed roller when an integral multiple of one complete rotation of the encoder scale member is detected.

8. An image recording apparatus according to claim 7, wherein the amount of rotation of said feed motor is greater than that of said feed roller.

9. An image recording apparatus according to claim 7, wherein the amount of rotation of driving said power transmitting means is greater than that of said feed roller.

10. An image recording apparatus according to claim 7, wherein said driving power transmitting means comprise pulleys and a belt, and said encoder scale member and one of said pulleys are coaxially mounted on said feed motor.

11. An image recording apparatus according to claim 7, wherein said driving power transmitting means comprises pulleys and a belt, and wherein said pulleys and belt provide a reduction ratio of 1:3 such that the feed roller makes one complete rotation for each three complete rotations of said motor.

12. An image recording apparatus according to claim 7, wherein said feed roller has a rotary members drivingly connected to said driving power transmitting means, and wherein said driving power transmitting means is a speed-reducing transmitting means in which the amount of rotation of said rotary members of said feed motor is greater than that of said rotary members of said feed roller.

13. A recording member feeding device, comprising:

a feed roller for feeding a recording member;

a feed motor for driving said feed roller;

driving power transmitting means for transmitting the driving power from the feed motor to said feed roller;

detecting means for measuring an amount of rotation of the feed roller, said detecting means comprising an encoder scale member mounted on said driving power transmitting means and an encoder scale sensor for detecting the amount of rotation of the encoder scale member; and a controller which stops the feeding operation by the feed roller when an integral multiple of one complete rotation of the encoder scale member is detected.

14. A recording member feeding device according to claim 13, wherein said driving power transmitting means has a rotary member, and said encoder scale member is coaxially mounted on said rotary member, and one complete rotation of said feed roller is associated with an integral multiple of one complete rotation of said encoder scale member.

15. An image recording apparatus according to claim 13 or 14, wherein said driving power transmitting means has a rotary member, and said encoder scale member is coaxially mounted on said rotary member, and one complete rotation of said feed roller is associated with an integral multiple of one complete rotation of said rotary member.

16. A recording member feeding device according to claim 13, wherein said driving power transmitting means has a gear, and said encoder scale member is coaxially mounted on said gear member, and one complete rotation of said feed roller is associated with an integral multiple of one complete rotation of said gear.

17. A recording member feeding device according to claim 13, wherein said driving power transmitting means comprises pulleys and a belt, and wherein said pulleys and belt provide a reduction ration of 1:3 such that the feed roller makes one complete rotation for each three complete rotations of one of said pulleys.

18. A recording member feeding device according to claim 13, wherein said feed motor comprises a motor gear, said driving power transmitting means comprises a transmission gear meshing with said motor gear, and said encoder scale member is mounted coaxially with said transmission gear, and one complete rotation of said feed roller is associated with an integral multiple of one complete rotation of said encoder scale member.

19. A recording member feeding device according to claim 13, wherein said driving power transmitting means comprises a transmission gear drove by said feed motor, and said encoder scale member is mounted coaxially mounted with said transmission gear, and said transmitting means provide a reduction ratio of 1:4 such that the feed roller makes one complete rotation for each four complete rotations of said motor.

20. An image forming apparatus, comprising:

a feed roller for feeding a recording member;

a feed motor for driving said feed roller;

driving power transmitting means for transmitting the driving power from the feed motor to said feed roller;

detecting means for measuring an amount of rotation of the feed roller, said detecting means comprising an encoder scale member mounted on said driving power transmitting means and an encoder scale sensor for detecting the amount of rotation of the encoder scale member; and a controller which stops the feeding operation by the feed roller when an integral multiple of one complete rotation of the encoder scale is detected, and image recording means for recording an image on a recording member fed by said feed roller.

21. An image forming apparatus according to claim 20, wherein the amount of rotation of said driving power transmitting means is greater than that of said feed roller.

22. A recording member feeding device, comprising;

a feed roller with a feed roller gear for feeding a recording member;

a feed motor with feed motor gear for driving said feed roller;

driving power transmitting means for transmitting the driving power from the feed motor gear to said feed roller gear;

detecting means for measuring an amount of rotation of said feed roller, said detecting means comprising an encoder scale member mounted on said driving power transmitting means and an encoder scale sensor for detecting the amount of rotation of the encoder scale member; and a controller which stops the feeding operation by said feed roller when an integral multiple of one complete rotation of the encoder scale member is detected.

* * * * *

UNITED STATES PATENT AND TRADEMARK OFFICE

CERTIFICATE OF CORRECTION

PATENT NO. : 6,685,370 B2
DATED : February 3, 2004
INVENTOR(S) : Soichi Hiramatsu It is certified that error appears in the above-identified patent and that said Letters Patent is hereby corrected as shown below:

Title page,
Item [30], Foreign Application Priority Data, "Jun. 16, 2000 (JP) …. 2000-183583" should read -- Jun. 19, 2000 (JP) …… 2000-183583 --.
Item [57], ABSTRACT,
Line 6, "he" should read -- the --.

Column 3,
Line 30, "operation" should read -- operations --.

Column 7,
Line 28, "paten" should read -- platen --.

Column 10,
Line 67, "members" should read -- member --.

Column 11,
Line 38, "members" should read -- member --.
Line 65, "An image recording apparatus" should read -- A recording member feeding device --.

Column 12,
Line 12, "ration" should read -- ratio --.
Line 24, "drove" should read -- driven --.
Line 25, "mounted" (2nd occurrence) should be deleted.

Signed and Sealed this

Eighth Day of June, 2004

JON W. DUDAS
*Acting Director of the United States Patent and Trademark Office*